US009005348B2

(12) United States Patent
Ott

(10) Patent No.: US 9,005,348 B2
(45) Date of Patent: Apr. 14, 2015

(54) SEGMENTED PORTABLE HUMIDITY CONTROL DEVICE FOR AN ENCLOSED VOLUME STORAGE DEVICE

(71) Applicant: Cigars International, Inc., Bethlehem, PA (US)

(72) Inventor: Bryan J. Ott, Hellertown, PA (US)

(73) Assignee: M&D Wholesale Distributors, Inc., Bethlehem, PA (US)

( * ) Notice: Subject to any disclaimer, the term of this patent is extended or adjusted under 35 U.S.C. 154(b) by 0 days.

(21) Appl. No.: 14/244,589

(22) Filed: Apr. 3, 2014

(65) Prior Publication Data

US 2014/0216956 A1 Aug. 7, 2014

(51) Int. Cl.

| | |
|---|---|
| ***B01D 53/02*** | (2006.01) |
| ***A24F 25/02*** | (2006.01) |
| ***B65D 21/02*** | (2006.01) |
| ***B65D 41/02*** | (2006.01) |

(52) U.S. Cl.

CPC ..... *A24F 25/02* (2013.01); *B65D 21/0202* (2013.01); *B65D 41/02* (2013.01)

(58) Field of Classification Search

CPC ..... A24F 25/02; B65D 21/0202; B65D 54/02
See application file for complete search history.

(56) References Cited

U.S. PATENT DOCUMENTS

| | | | | |
|---|---|---|---|---|
| 4,098,421 | A | 7/1978 | Foster | |
| D306,139 | S | 2/1990 | Bridel | |
| 5,105,961 | A | 4/1992 | Noren et al. | |
| 5,158,582 | A * | 10/1992 | Onitsuka et al. | 95/129 |
| 5,169,414 | A * | 12/1992 | Panzica et al. | 95/113 |
| 5,307,945 | A | 5/1994 | Hidding et al. | |
| 5,512,083 | A * | 4/1996 | Dunne | 95/113 |
| 5,702,508 | A * | 12/1997 | Moratalla | 96/118 |
| D391,670 | S | 3/1998 | Hargrove | |
| 5,730,785 | A | 3/1998 | Idol et al. | |
| 5,901,710 | A | 5/1999 | Barber | |
| 5,936,178 | A | 8/1999 | Saari | |
| 5,957,278 | A | 9/1999 | Krawec et al. | |
| 5,975,288 | A | 11/1999 | Crowder et al. | |
| D435,143 | S | 12/2000 | Post, Jr. | |
| 6,244,432 | B1 | 6/2001 | Saari et al. | |
| 6,432,179 | B1 * | 8/2002 | Lobovsky et al. | 96/296 |
| 6,780,227 | B2 * | 8/2004 | DuBose et al. | 96/125 |
| 6,942,712 | B2 * | 9/2005 | Hamanaka et al. | 55/523 |
| 7,077,187 | B2 * | 7/2006 | Cargnelli et al. | 165/4 |

(Continued)

OTHER PUBLICATIONS

The Notice of Allowance, mailed on Sep. 29, 2014, in related U.S. Appl. No. 29/486,904.

*Primary Examiner* — Christopher P Jones

(57) ABSTRACT

A device for controlling a relative humidity level in an enclosed volume storage device includes a plurality of container segments each including two side walls with internal edges joined at an interior edge of the container segment, an outer wall extending between external edges of the two side walls, a base wall extending between bottom edges of each of the two side walls and the outer wall of the container segment, and a permeable top wall. The container segments are configured in a first instance to be compactly adjacently positioned so that each side wall of a container segment abuts another side wall of another container segment and the segments are radially arrayed around a central axis of the device. A binding element is applied to maintain the segments in this position. The binding element is removable to allow the segments to be individually distributed within the storage device.

16 Claims, 8 Drawing Sheets

(56) References Cited

U.S. PATENT DOCUMENTS

| | | | | |
|---|---|---|---|---|
| D591,172 | S | 4/2009 | Keberlein et al. | |
| 7,765,775 | B2 | 8/2010 | DeFedericis | |
| 7,833,325 | B2 | 11/2010 | Merdzo | |
| 7,892,327 | B2 | 2/2011 | Neff | |
| D637,903 | S | 5/2011 | Ghiotti et al. | |
| D653,767 | S | 2/2012 | Lovshe | |
| 8,211,209 | B2 | 7/2012 | Neff | |
| 8,257,470 | B2 | 9/2012 | Lee et al. | |
| 8,317,053 | B2 | 11/2012 | Cronin et al. | |
| 2005/0225089 | A1* | 10/2005 | Ben-Horin | 285/414 |
| 2012/0183444 | A1 | 7/2012 | Lee | |
| 2013/0092684 | A1 | 4/2013 | Roger | |

* cited by examiner

SEGMENTED PORTABLE HUMIDITY CONTROL DEVICE FOR AN ENCLOSED VOLUME STORAGE DEVICE

TECHNICAL FIELD

This disclosure pertains to a device for controlling relative humidity within an enclosed volume storage device, and more particularly, to a device for controlling relative humidity within a humidor.

BACKGROUND

Devices for controlling relative humidity levels within an enclosed volume storage device are known in the art. One such device is described in U.S. Pat. No. 7,892,327 to Neff ("the '327 patent), issued Feb. 22, 2011, which is hereby incorporated by reference herein in its entirety.

As described in the '327 patent, the range of relative humidity at which tobacco products such as cigars should be stored to optimize freshness generally understood as being between 64% relative humidity to minimize drying of the tobacco and below 72% relative humidity to inhibit the growth of mold, mildew and prevent the hatching of the Cigarette or Tobacco Beetle, or *Lasioderna serricome*, with 65-70% relative humidity being ideal. Numerous efforts have been directed toward achieving this level of humidity in confined environments, such as humidors, through the incorporation of moisture-moderating materials and associated devices. Silica gel beads (for example, as available from Heartfelt Industries of Carson City, Nev.), propylene glycol beads (for example, HUMI-CARE crystal gel humidification beads available from Cigars International of Bethlehem, Pa.) and superabsorbent polymer grains (for example, as available from M2 polymer Technologies of West Dundee, Ill.), which can be used to effectively adsorb and desorb moisture, are suitable moisture-moderating materials. In some cases, for improved performance, these materials are used in combination with liquids such as distilled water or polyethylene glycol. A particularly suitable moisture-moderating material for the humidity control devices described herein are BLACK ICE humidification beads available from Cigars International of Bethlehem, Pa.

Referring now to FIG. 1, a prior art humidification regulating apparatus 10 as disclosed by the '327 patent is shown in exploded perspective view. Apparatus 10 comprises a cylindrical container (base) 11, and is adapted to house a quantity of a composition 12 as described above that is capable of as adsorbing and desorbing moisture. The container is closed at one end (its "bottom" side, not visible) and is provided with a removable closure element such as lid 13 having perforations 15 at the other end. Lid 13 has a circumference slightly larger than the circumference of the peripheral edge of the container 11 so as to overlap the container (base) 11 in a substantially sealing engagement about end opening of the container 11. For purposes of securing the lid 13 to the container 11, the lid 13 engages threads on the peripheral region of the upper edge of the walls of container 11.

Apparatus 10 of the '327 patent also comprises a retaining member 14, such as a porous cloth, porous urethane, or a sponge, which acts to inhibit transfer of the composition 12 through perforations 15 when the apparatus 10 is inverted (for example, if the "bottom" of the apparatus 10 is removably attached to the underside of a closed lid of a storage device (e.g., humidor), as shown in FIG. 2, discussed below).

The composition 12 controls relative humidity to a predetermined level, through absorbing or desorbing water vapor through the perforations 15 in lid 13. If a greater desorption is desired, for example, the composition 12 may be moistened through direct hydration by removing lid 13 and retaining member 14 or by absorbing moisture from a directly hydrated retaining member 14.

Container 10 is fashioned from a material which is lightweight and has a means of allowing the composition 12 to absorb and desorb water (e.g., as water vapor), preferably through perforations 15 in the lid 13. The perforations 15 in the lid 13 are of a size and shape that allow an adequate flow of water vapor to maintain the predetermined relative humidity level within the container 10. The rate of absorption and desorption will depend upon the perforation size and pattern, as well as the volume of the composition 12 within the container 10.

The container 10 shown in FIG. 1 is placed within a storage device such as a cigar box or humidor, or other environment wherein humidity regulation is desired. As shown in FIG. 2, the bottom of container 11 is affixed to the interior surface of the lid of a cigar box or humidor, for example using a securing device such as a magnet or hook and loop fabric such as VELCRO. However, because the apparatus can be placed at only a single location within the storage device, it may be difficult to achieve a uniform relative humidity level throughout the entire interior volume of the storage device.

SUMMARY

Briefly, aspects of the present disclosure are directed to a device for controlling a relative humidity level in an enclosed volume storage device, for example, such as a small cigar humidor. The device is initially configured in a first configuration for transportation and handling as a single, compact and integrated package, and later disaggregated into multiple segments that can be positioned at a variety of distributed locations within the cigar humidor. In this manner, control can be applied in a more uniform manner across the interior volume of the cigar humidor.

According to aspects of the present disclosure, the humidity control device includes a plurality of container segments each having a plurality of walls defining an interior volume of the segment. The plurality of walls includes two side walls with internal edges joined at an interior edge of the container segment, an outer wall extending between external edges of the two side walls, a base wall extending between bottom edges of each of the two side walls and the outer wall of the container segment, and a permeable top wall. The container segments are configured to be compactly adjacently positioned so that each side wall of a container segment abuts another side wall of another container segment. In this position, the container segments are radially arrayed around a central axis that is substantially proximal to the interior edges of the container segments. The humidity control device further includes a binding element removably applied to the container segments to maintain the container segments in the compactly adjacent position.

According to another aspect of the present disclosure, the plurality of container segments includes four container segments radially arrayed around the central axis, and the side walls of each segment meet at the interior edge to define a right angle.

According to another aspect of the present disclosure, the permeable top wall of each container segment forms a portion of an insert that is matingly inserted within a cavity defined by top edges of each of the two side walls and the outer wall. The permeable top wall includes perforations aligned along a plurality of rays extending from a vertex located at an interior edge of the insert.

According to another aspect of the present disclosure, the binding element comprises a cap which has a cylindrical interior surface with interior threads. Each of the container segments has external thread segments applied to the outer walls at a position adjacent to top ends of the segments. In the compactly adjacent position, the external threads of the container segments are aligned at the outer edges of the segments to form a continuous outer thread upon which the cylindrical cap may be screwed to maintain the segments in the compactly adjacent position.

According to another aspect of the present disclosure, humidification grains are provided within the interior volume of each container segment. As described above, a particularly suitable type of humidification grains for use as described herein are BLACK ICE humidification beads available from Cigars International of Bethlehem, Pa.

This SUMMARY is provided to briefly identify some aspects of the present disclosure that are further described below in the DESCRIPTION. This SUMMARY is not intended to identify key or essential features of the present disclosure nor is it intended to limit the scope of any claims.

The term "aspects" is to be read as "at least one aspect." The aspects described above and other aspects of the present disclosure described herein are illustrated by way of example (s) and not limited in the accompanying drawing.

BRIEF DESCRIPTION OF THE DRAWING

A more complete understanding of the present disclosure may be realized by reference to the accompanying drawing in which.

DESCRIPTION

Figure 1:
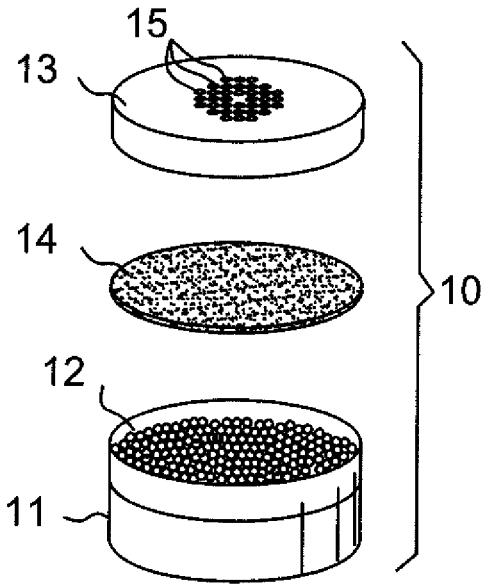
FIG. 1 (PRIOR ART)
FIG. 1 is an exploded perspective diagram showing a conventional humidity control apparatus.

The following merely illustrates the principles of the disclosure. It will thus be appreciated that those skilled in the art will be able to devise various arrangements which, although not explicitly described or shown herein, embody the principles of the disclosure and are included within its spirit and scope.

Furthermore, all examples and conditional language recited herein are principally intended expressly to be only for pedagogical purposes to aid the reader in understanding the principles of the disclosure and the concepts contributed by the inventor(s) to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Unless otherwise explicitly specified herein, the drawings are not drawn to scale.

We now provide some non-limiting, illustrative examples that illustrate several operational aspects of various arrangements and alternative embodiments of the cigar box presented in the present disclosure.

As used herein, directional terms as may be used such as "horizontal," "vertical," "front", "rear", "left," "right," "inner," "outer," "interior" and "exterior" relate to an orientation of the disclosed humidity control device from the perspective of a typical user, and do not specify permanent, intrinsic features or characteristics of the device.

Aspects of the present disclosure describe a humidity control device 100 used for controlling relative humidity within an enclosed volume storage device (for example, within a conventional wooden cigar humidor that holds on the order of 20 to 500 cigars). As best shown in FIGS. 3-8, the humidity control device 100 includes a plurality of container segments 110 each having an interior volume configured to hold humidification grains 140 or another suitable humidification/dehumidification medium that is capable of adsorbing and desorbing gaseous water vapor in order to control the relative humidity of a surrounding exterior environment. As described above, a particularly suitable type of humidification grains for the humidity control devices described herein are BLACK ICE humidification beads available from Cigars International of Bethlehem, Pa.

Each container segment 110 of the humidity control device 100 is preferably formed as a unitary molding including two side walls 111 that are joined along a linear interior edge 112, an outer wall 114 that is joined to and extends between outer edges 113 of each of the two side walls 111, and a base wall 115 that is sealably joined to bottom edges of side walls 111 and outer wall 114. The molding is preferably formed from a non-permeable material. Although depicted in FIGS. 3-7 as a material that is transparent and tinted, aspects of the present disclosure also contemplate a molding formed from materials that may be non-tinted rather than tinted, and/or translucent or opaque rather than transparent. Preferred materials for the container segment 110 include but are not limited to acrylonitrile butadiene styrene (ABS), polyethylene, clarified polyethylene, polypropylene, clarified polypropylene, extrusion blow-moldable copolyester, polycarbonate, propionate, polymers, plastics, resins, composites and/or lightweight metals.

Figure 6:
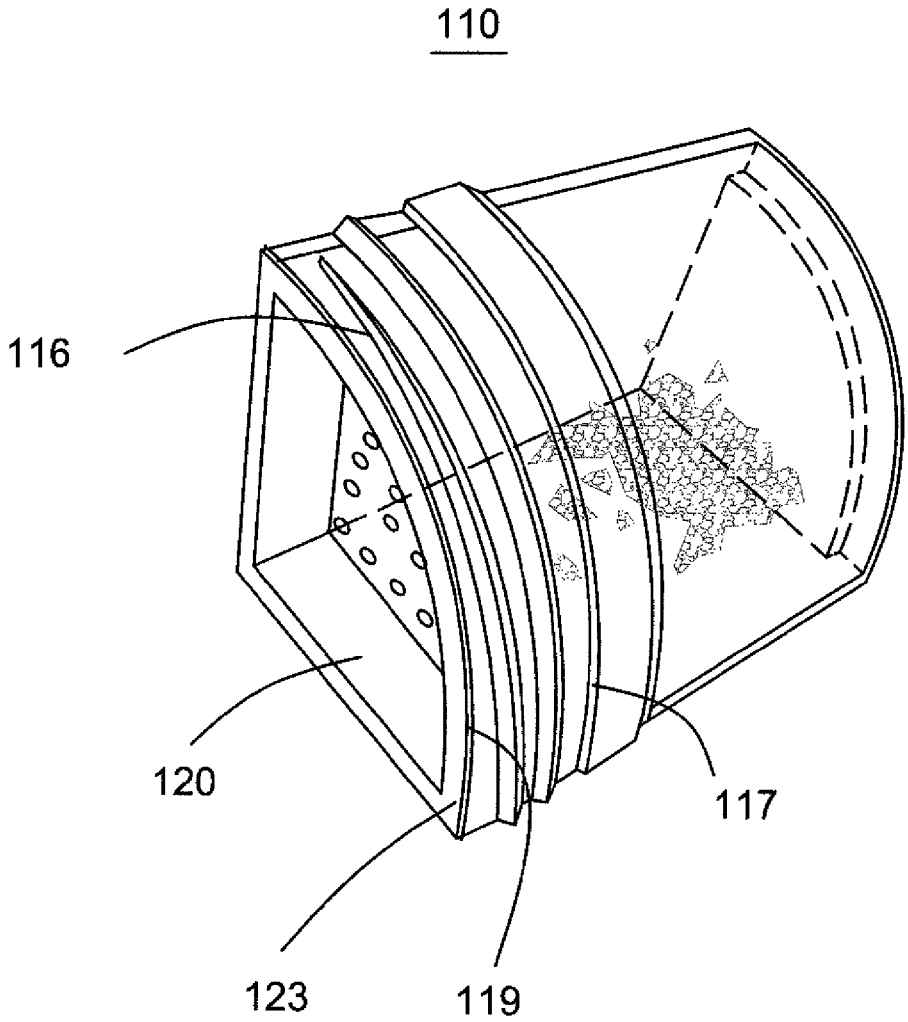
FIG. 6 is a perspective diagram of one container segment of the humidity control device shown in FIGS. 3 and 4.
Figure 7:
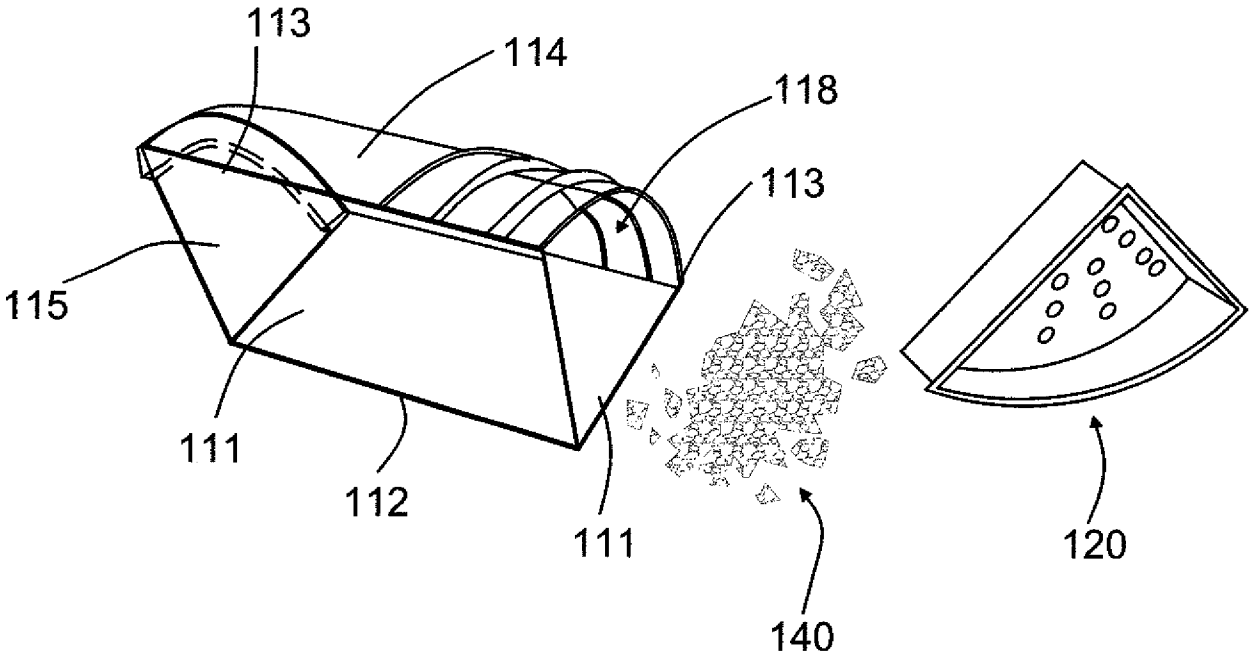
FIG. 7 is an exploded perspective diagram of the container segment shown in FIG. 6.

As depicted for example in FIGS. 6 and 7, the container segments 110 may in addition preferably include an insert 120 that is matingly inserted within an opening 118 defined by top edges 119 and interior surfaces of the side walls 111 and outer wall 114. As depicted for example in FIG. 8, the insert 120 may be formed as a unitary molding including side walls 124 and outer wall 128 that are joined to and extend between a top wall 125 and a flange 123 of the insert 120. The side walls 124 outer wall 128 of the insert 120 are configured to conformably fit against the interior surfaces of the side walls 111 and outer wall 114 of the container segment 110, respectively.

As illustrated in FIG. 6, a flange 123 of the insert 120 abuts the top edge 119 of the side walls 111 and outer wall 114 of the container segment 110, in order to fixedly locate the top wall 125 vertically and laterally relative to the container segment 110. Alternatively, for example, the top wall 125 could be vertically fixed against an inwardly-extending ledge that could be provided on the interior surfaces of the side walls 111 and outer wall 114 of the container segment 110.

Figure 8:
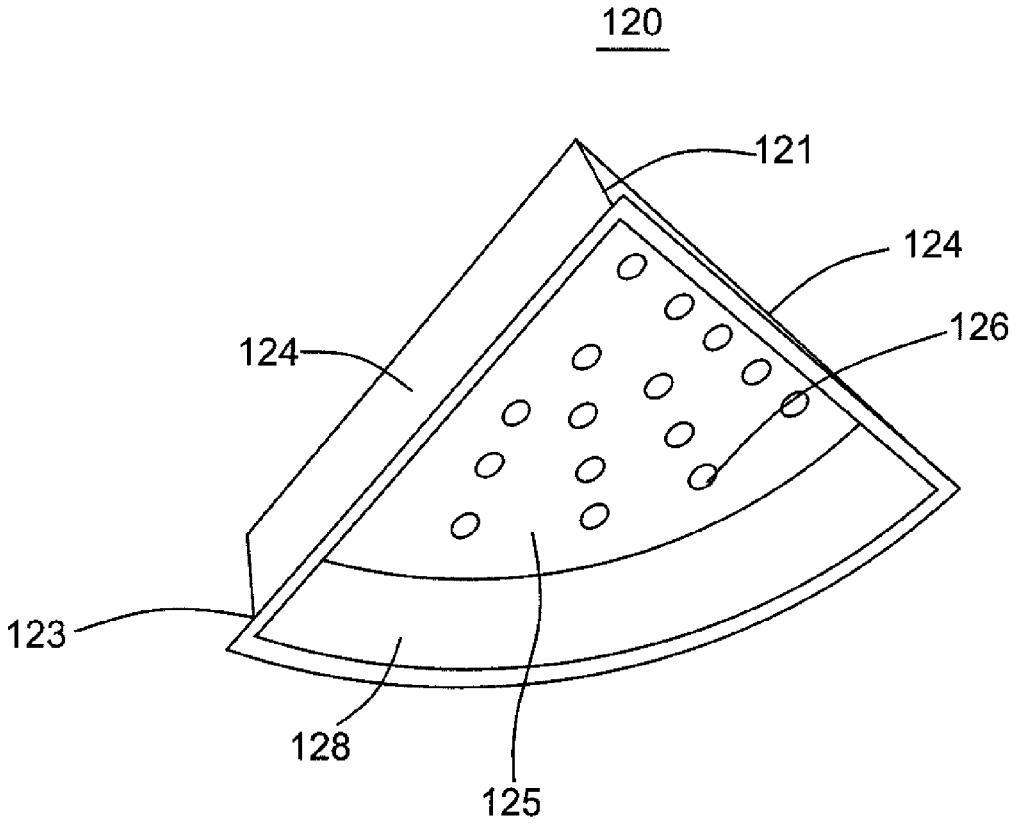
FIG. 8 is a perspective diagram showing an insert component of the segment of FIG. 6.

The insert 120 is preferably formed as a unitary molding. Preferred materials for the insert 120 include but are not limited to polystyrene, nylon, and polyurethane. As illustrated in FIG. 8, the top wall 125 of the insert 120 includes perforations 126 that permit the humidification grains 140 or other humidification medium provided within the interior volume of the container 110 to adsorb or desorb water vapor present in the surrounding exterior environment. The perforations 126 depicted in FIG. 8 may preferably extend in linear rays away from an interior edge 121 of the insert 120. Alternatively, the perforations may be arranged in any alternate pattern that permits water vapor to be effectively transferred between the interior volume of the container segment 110 and its surrounding exterior environment. In addition, the top wall 125 and/or other portions of the insert 120 may alternatively be formed from a material that is water vapor-permeable (for example, by using a porous plastic material available from Atlas Minerals & Chemicals, Inc. of Mertztown, Pa.).

Figure 4:
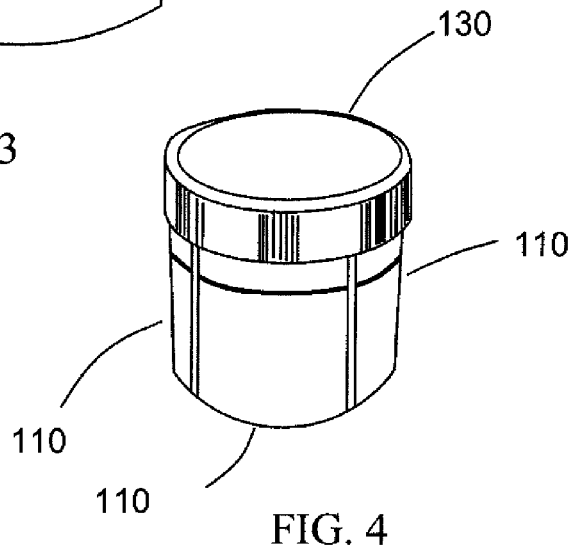
FIG. 4 is a perspective diagram of the humidity control device shown in FIG. 3, showing the cap component applied to the device.

With reference to FIGS. 3-6, the humidity control device 100 further includes a cap 130 which is configured to act as a binding element for maintaining the container elements 110 in a fixed position and compactly adjacent to one another (for example, see FIG. 4). The cap 130 is preferably formed as a unitary molding. Preferred materials for the cap 130 include but are not limited to ABS, polyethylene, clarified polyethylene, polypropylene, clarified polypropylene, extrusion blow-moldable copolyester, polycarbonate, propionate, polymers, plastics, resins, composites and/or lightweight metals.

Figure 5:
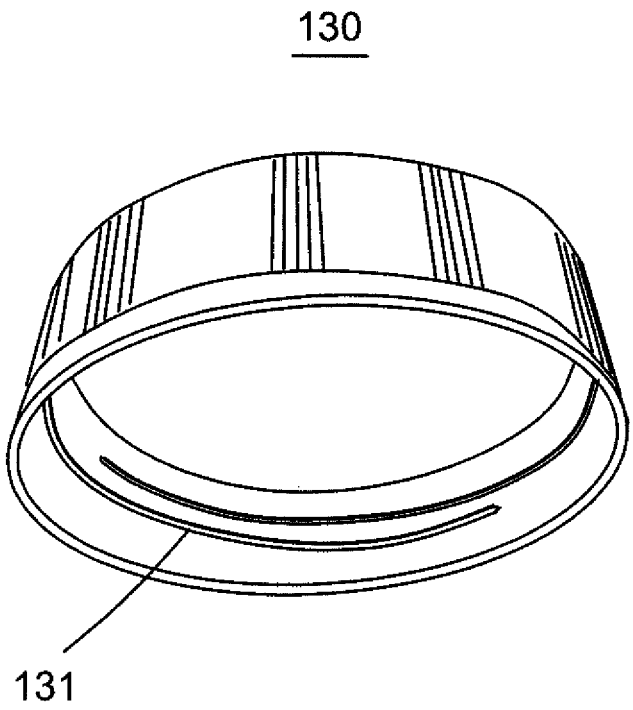
FIG. 5 is a perspective diagram of the cap component shown in FIGS. 3 and 4.

As illustrated in FIGS. 5 and 6, the cap 130 is provided with one or more internal threads 131 that can be mated with one or more exterior threads formed by exterior thread segments 116 on each of the container segments 110.

When coordinatedly positioned in the compactly adjacent position, in which side walls of adjacent container segments 110 abut one another, the container segments 110 are radially arrayed around a central axis substantially defined by the interior edges 112, and the exterior thread segments 116 are aligned at the outer edges 113 of the container segments 110 to form the one or more continuous exterior threads suitable for mating with the interior threads 131 of the cap 130. When the threads 131 of the cap 130 are mated with the threads formed by the thread segments 116 by screwing the cap 130 onto the container elements 110, the container elements 110 are fixedly bound in the compactly adjacent position. Preferably, the outer walls 114 of one or more container elements 110 are further provided with a cap stop 117 for limiting the downward travel of the cap 130 as it is being screwed onto the container segments 110 to a fixed vertical position.

As an alternative to the threaded cap 130 and container segments 110 described above, the cap 130 may be configured with another retaining feature in addition to or in lieu of threads. For example, the cap 130 and container segments 110 may be provided with a conventional ring and groove arrangement for fixing the cap 130 by snapping it into place after it has been fit over the top ends of the container segments 110 in the compactly adjacent position. Alternatively, the cap may be formed from a flexible material that may be slid over the top edges 119 of the outer walls of the container segments 110 in the compactly adjacent position for a frictional and conformal fit against outer surfaces of the outer walls 114 at the top end of the container segments 110. The flexible material in this case may be selected as one of natural or synthetic rubber, polystyrene, nylon, and polyurethane. As an alternative to the cap 130, the flexible material may be formed instead as a band that is slid over the top edges 119 of the outer walls of the container segments 110.

Aspects of the present disclosure contemplate that each of the alternative cap and/or binding element features described above may alternatively be provided at a bottom end rather than at a top end of the container segments 110 in the compactly adjacent position.

Figure 9:
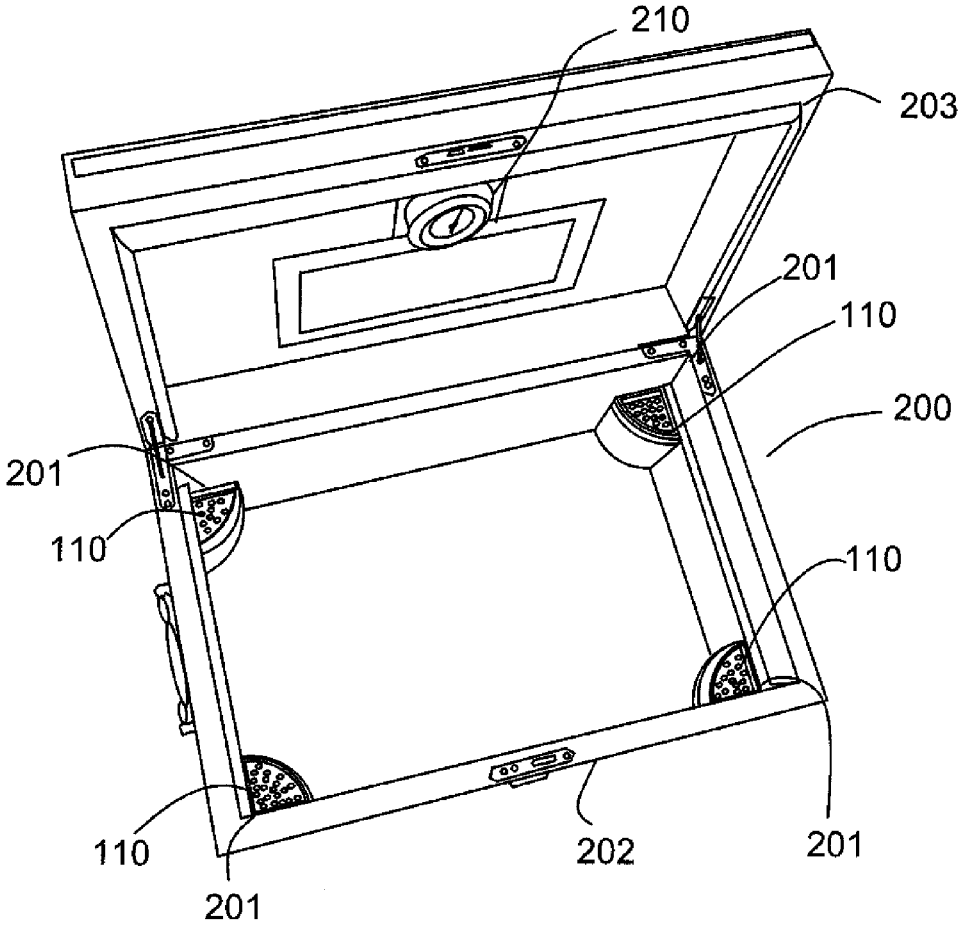
FIG. 9 is a perspective diagram showing container segments of the humidity control device shown in FIGS. 3 and 4, as distributedly positioned in an enclosed volume storage device.

FIG. 9 illustrates aspects of the present disclosure relating to use of the humidification device 110 within the interior volume of a cigar humidor 200. As shown in FIG. 9, the cap 130 has been unscrewed and removed, and the container segments 110 once unbound from the compactly adjacent position have been individually positioned at interior corners 201 within a base 202 of the humidor 200. A conventional hygrometer 210 is preferably provided (for example, affixed to a lid 203 of the humidor 200) to monitor relative humidity within an enclosed volume of the humidor 200 when the lid 203 is closed against the base 202.

Figure 2:
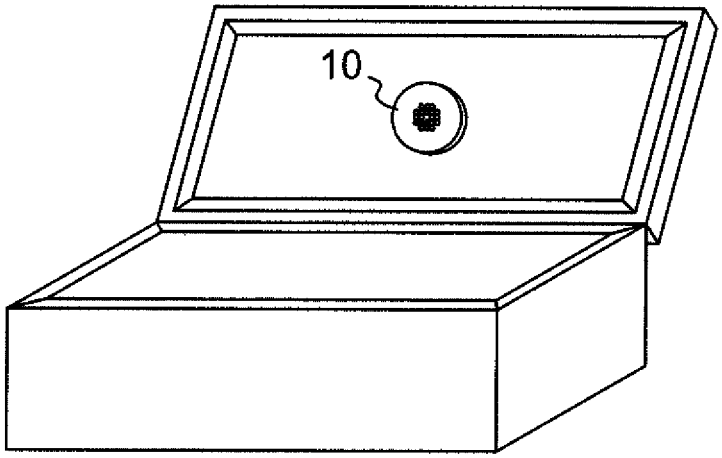
FIG. 2 (PRIOR ART)
FIG. 2 is a perspective diagram showing the conventional humidity control device of FIG. 1 in an enclosed volume storage device.
Figure 3:
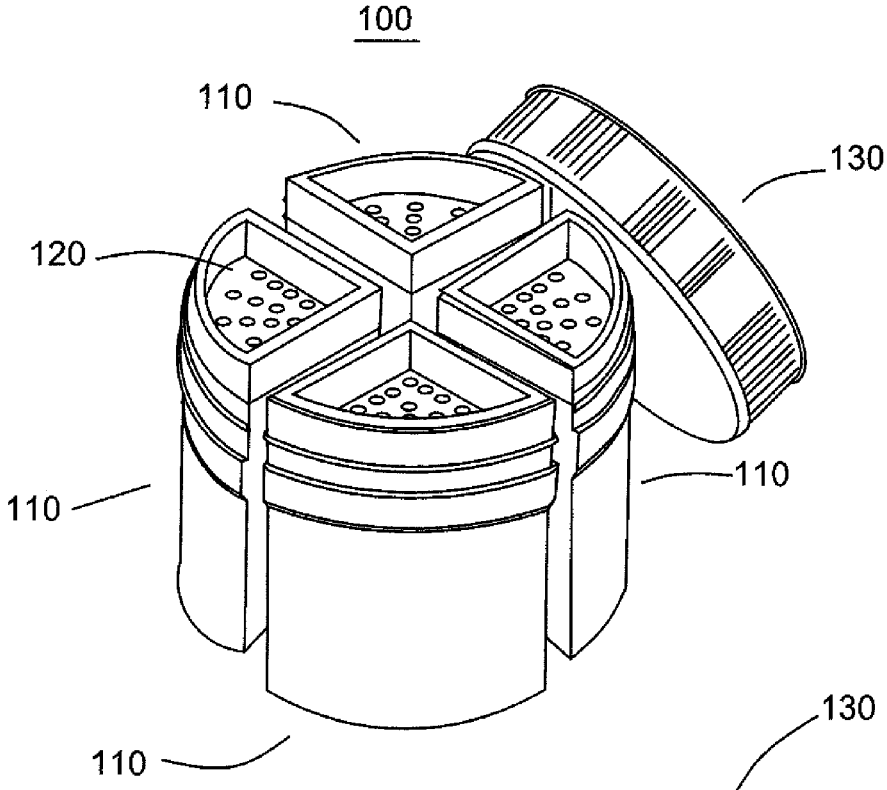
FIG. 3 is a perspective diagram of a humidity control device according to an aspect of the present disclosure, showing a cap component as removed from the device.

In contrast to the single prior art device 10 depicted in FIG. 2, the multiple unbound corner-distributed segments 110 according to aspects of the present disclosure provide humidification that will likely avoid producing a significant variance in relative humidity at various positions within the enclosed volume of the humidor 200. Notably, when bound in the compactly adjacent position, while the footprint of the segments 110 are essentially equivalent to the footprint to the prior art device 10.

The device 100 as illustrated by the present disclosure includes four segments 110 that are radially arrayed around a central axis that is substantially proximal to the interior edges 112 of the segments 110 in the compactly adjacent position. The interior walls 111 of each of the four segments 110 define interior angles that are right angles, thereby enabling the segments 110 to be easily positioned in the corners 201 defining the rectangular space in the base 202 of the humidor 200. It should never-the-less be noted that present disclosure contemplates configurations of the device 100 having a different number of radially-distributed segments than illustrated by the present disclosure, with walls 111 defining other than right angles. This may be necessary to provide segments 110 that can be easily positioned in humidors having enclosed volumes defined by other than purely rectangular volumes (and corners defining other than right angles). In addition, the present disclosure contemplates configurations of the device 100 having at least two or more segments 110 with walls 111 defining different interior angles.

Figure 10A:
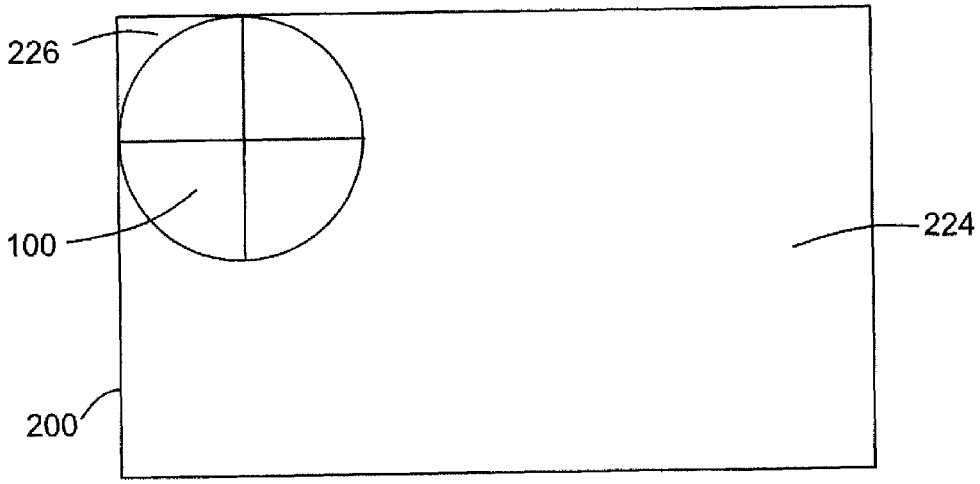
FIGS. 10A and 10B are schematic diagrams illustrating an effect of a non-distributed positioning of the container segments relative to the distributed positioning, respectively.
Figure 10B:
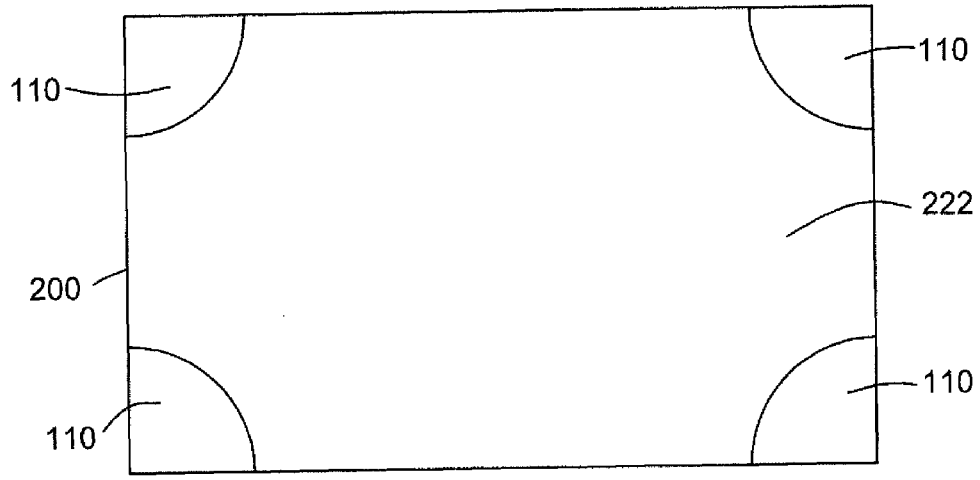

FIGS. 10A and 10B are schematic diagrams respectively illustrating the footprints of the container segments 110 in the compactly adjacent position (as device 100) and in the unbound position (as segments 110) at the interior corners 201 of the base 202. While the total footprint of the segments 110 in either case is invariant, it can be readily seen that the footprint 222 of FIG. 10B in which the segments 110 are distributed at the interior corners 201 provides a more usable space within the humidor 200 for receiving cigars than the footprint 224 of FIG. 10A with the segments in the compactly adjacent position. Moreover, by providing side walls 111 of the container segments 110 in FIG. 10B that tightly fit against the corners 201 of the humidor 200, unusable areas such as area 226 of the footprint 224 of FIG. 10A can be completely avoided. As a result, a greater usable area is potentially available within the footprint 222 of FIG. 10B as compared to the footprint 224 of FIG. 10A.

REFERENCE CHARACTER TABLE

The following table lists the reference characters and names of features and elements used herein:

| Ref. char. | Feature or element |
|---|---|
| 10 | humidification regulating apparatus |
| 11 | container |
| 12 | composition |
| 13 | lid |
| 14 | retaining member |
| 15 | perforations |
| 100 | humidification control device |
| 110 | container segment |
| 111 | side wall |
| 112 | interior edge |
| 113 | outer edge |
| 114 | outer wall |
| 115 | base wall |
| 116 | exterior thread segments |
| 117 | cap stop |
| 118 | opening |
| 119 | top edge |
| 120 | insert |
| 121 | interior edge |
| 123 | flange |
| 124 | side wall |
| 125 | top wall |
| 126 | perforations |
| 128 | outer wall |
| 130 | cap |
| 131 | internal threads |
| 140 | humidification grains |
| 200 | humidor |
| 201 | interior corner |
| 202 | base |
| 203 | lid |
| 210 | hygrometer |
| 222 | humidor footprint for distributed container segments |
| 224 | humidor footprint for non-distributed container segments |
| 226 | unusable area in humidor footprint for non-distributed container segments |

It will be understood that, while presently preferred embodiments of the invention have been illustrated and described, the invention is not limited thereto, but may be otherwise variously embodied within the scope of the following claims.

The invention claimed is:

1. A device for controlling a humidity level within an enclosed volume storage device, comprising:

a plurality of container segments each having a plurality of walls defining an interior volume, the walls comprising two side walls with internal edges joined at an interior edge of the container segment, an outer wall extending between external edges of the two side walls, a base wall extending between bottom edges of each of the two side walls and the outer wall of the container segment, and a permeable top wall; and a cap comprising a cylindrical interior surface having one or more interior threads, wherein the container segments are compactly adjacently positioned so that each side wall of a container segment abuts another side wall of another container segment, the container segments as positioned being radially arrayed around a central axis substantially proximal to the interior edges of the container segments, and wherein each of the container segments comprises external thread segments applied to the outer walls adjacent to top end of the segments, such that the thread segments of the compactly adjacently positioned container segments are aligned at outer edges of the segments to define one or more exterior threads configured for mating with the one or more interior threads of the cap.

2. The device of claim 1, wherein the permeable top wall of each container segment comprises an insert that is matingly inserted within a cavity defined by top edges of each of the two side walls and the outer wall.

3. The device of claim 2, wherein the insert comprises a unitary molding.

4. The device of claim 3, wherein the insert comprises a material selected from the group consisting of polystyrene, nylon, and polyurethane.

5. The device of claim 1, wherein the permeable top wall of each container segment comprises perforations aligned along a plurality of rays extending from a vertex located on the interior edge.

6. The device of claim 1, wherein each container segment comprises a unitary molding.

7. The device of claim 6, wherein each container segment comprises a material selected from the group consisting of acrylonitrile butadiene styrene (ABS), polyethylene, clarified polyethylene, polypropylene, clarified polypropylene, extrusion blow-moldable copolyester, polycarbonate, propionate, polymers, plastics, resins, composites and lightweight metals.

8. The device of claim 1, wherein the outer walls of the container segments positioned in the compactly adjacent position collectively define a cylinder .

9. The device of claim 1, wherein the cap comprises a material selected from the group consisting of acrylonitrile butadiene styrene (ABS), polyethylene, clarified polyethylene, polypropylene, clarified polypropylene, extrusion blow-moldable copolyester, polycarbonate, propionate, polymers, plastics, resins, composites and lightweight metals.

10. The device of claim 1, further comprising humidification grains provided within the interior volume of each container segment.

11. The device of claim 1, wherein the plurality of container segments comprises four container segments radially arrayed around the central axis, and the side walls of each segment meet at the interior edge to define a right angle.

12. A humidor comprising:

an enclosed volume storage device having an interior volume delimited by a plurality of interior walls adjoined pairwise to define a plurality of corners of the enclosed volume storage device; and a plurality of container segments each having a plurality of walls defining an interior volume of the container segment, the walls comprising two side walls with internal edges joined at an interior edge of the container segment, an outer wall extending between external edges of the two side walls, a base wall extending between bottom edges of each of the two side walls and the outer wall of the container segment, and a permeable top wall, wherein the container segments are individually positioned so that the side walls of each segment abut one of the adjoined pairs of interior walls defining one of the plurality of corners of the enclosed volume storage device.

13. The humidor of claim 12, wherein the humidor is a cigar humidor.

14. The humidor of claim 12, wherein:

the enclosed volume storage device has an approximately rectangular interior volume, the plurality of corners comprise four corners, and a footprint of an entire interior volume of the enclosed volume storage device omitting footprints of the container segments positioned proximate to each of the four corners is fully contiguous.

15. A device for controlling a humidity level within an enclosed volume storage device having an approximately rectangular interior volume delimited by a plurality of interior walls adjoined pairwise to define four interior corners, the humidity controlling device comprising:

one or more container segments each having a plurality of walls defining a hollow interior volume, the walls comprising two side walls with internal edges joined at an interior edge of the container segment, an outer wall extending between external edges of the two side walls, a base wall extending between bottom edges of each of the two side walls and the outer wall of the container segment, and a permeable top wall, wherein each of the one or more container segments is configured to be positioned at one of the corners of four interior corners of the enclosed volume storage device so that the side walls of the segment abut the pairwise joined interior walls defining the one corner.

16. The humidity controlling device of claim 15, wherein each of the one or more container segments comprises external thread segments applied to the outer wall of the segment adjacent to a top end of the segment.

* * * * *